US008506043B2

(12) United States Patent
Satake

(10) Patent No.: US 8,506,043 B2
(45) Date of Patent: Aug. 13, 2013

(54) INKJET RECORDING APPARATUS

(75) Inventor: Kenichi Satake, Osaka (JP)

(73) Assignee: Kyocera Document Solutions Inc, Osaka (JP)

( * ) Notice: Subject to any disclaimer, the term of this patent is extended or adjusted under 35 U.S.C. 154(b) by 195 days.

(21) Appl. No.: 13/017,487

(22) Filed: Jan. 31, 2011

(65) Prior Publication Data

US 2011/0205294 A1 Aug. 25, 2011

(30) Foreign Application Priority Data

Feb. 22, 2010 (JP) ..... 2010-036208

(51) Int. Cl.
*B41J 2/165* (2006.01)

(52) U.S. Cl.
USPC ..... 347/33

(58) Field of Classification Search
USPC ..... 347/22, 31, 33
See application file for complete search history.

(56) References Cited

FOREIGN PATENT DOCUMENTS

| | | |
|---|---|---|
| JP | 2004-148770 | 5/2004 |
| JP | 2005-161796 | 6/2005 |
| JP | 2008-179056 | 8/2008 |

OTHER PUBLICATIONS

Notice of Reasons for Rejection issued to JP Application No. 2010-035208, mailed Jun. 5, 2012.

*Primary Examiner* — Lamson Nguyen
(74) *Attorney, Agent, or Firm* — Dilworth & Barrese, LLP.

(57) ABSTRACT

An inkjet recording apparatus is provided, which includes a plurality of recording heads that record an image on a recording medium by ink ejected from the inkjet nozzles and a plurality of wiper members, each arranged corresponding to each recording head, and performing cleaning of a nozzle face of each recording head by moving relative to each recording head. Timing at which at least one of the wiper members abuts against one recording head is different from another timing at which another wiper member differing from the one wiper member abutting against the one recording head abuts against another recording head.

10 Claims, 9 Drawing Sheets

INKJET RECORDING APPARATUS

This application is based on and claims the benefit of priority from Japanese Patent Application No. 2010-036208, filed on 22 Feb. 2010, the content of which is incorporated herein by reference.

BACKGROUND OF THE INVENTION

1. Field of the Invention

The present invention relates to an inkjet recording apparatus that records information on a recording medium such as paper by ink ejected through nozzles.

2. Related Art

A recording head in an inkjet recording apparatus has a nozzle face on which a plurality of nozzles ejecting ink is formed. Cleaning of this nozzle face is required in order to prevent circumstances where it is not possible to eject ink or where the ink ejection direction is altered, due to ink and foreign matter such as dust adhering to the vicinity of the nozzles.

In relation to cleaning of a nozzle face, a technique is known for removing ink adhering to the nozzle face by carrying out cleaning (wiping) of the nozzle face with a wiper member.

More specifically, a front end of the wiper member abuts against a recording head so as to bend, and then moves in a direction along the nozzle face with the front end bent, thereby cleaning the nozzle face. Accordingly, a load is applied to a motor which drives the wiper member, from the time that the front end of the wiper member abuts against the recording head until the wiper member has formed a prescribed bent shape.

An inkjet recording apparatus is known which includes a plurality of recording heads and a plurality of wiper members, wherein the wiper members are driven by a single motor (drive source).

In the above described inkjet recording apparatus, each of the plurality of wiper members abuts simultaneously against each of the plurality of recording heads. Therefore, loads are applied simultaneously to the single motor (drive source) which drives the plurality of wiper members (in other words, a large load is applied to the motor).

An object of the present invention is to provide an inkjet recording apparatus which reduces a load acting on a drive source which drives a plurality of wiper members.

SUMMARY OF THE INVENTION

An inkjet recording apparatus is provided, which includes a plurality of recording heads and a plurality of wiper members. The recording heads each include a nozzle face in which inkjet nozzles are formed, and record an image on a recording medium by ink ejected from the inkjet nozzles. The wiper members are each arranged corresponding to each recording head and perform cleaning of the nozzle face of each recording head by moving relative to each recording head. The wiper members move in a wiping direction along nozzle faces after respective front ends of the wiper members abut against the recording heads. Timing at which at least one of the wiper members abuts against one recording head is different from another timing at which another wiper member differing from the one wiper member abutting against the one recording head abuts against another recording head.

According to the present invention, it is possible to provide the inkjet recording apparatus which can reduce the load on the drive source that drives the plurality of wiper members.

DETAILED DESCRIPTION OF THE INVENTION

First Embodiment

A first embodiment of the present invention is described hereinafter with respect to the drawings.

An overview of the structure of an inkjet recording apparatus 1 according to a first embodiment of the present invention is described with reference to FIG. 1 and FIG. 2.

Figure 1:
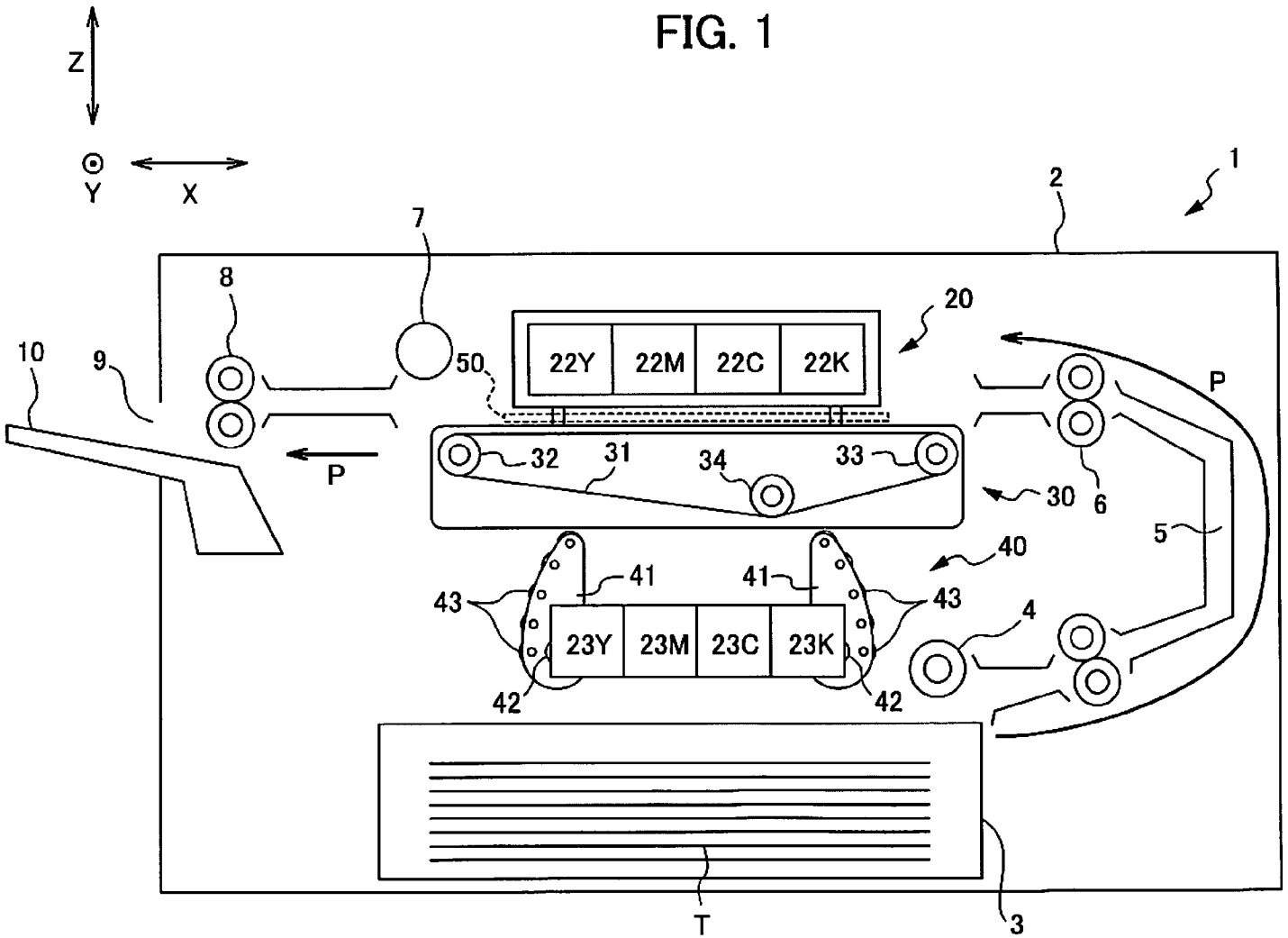
FIG. 1 is a vertical cross-sectional view from a front side showing schematically an overview of an inkjet recording apparatus 1 of a first embodiment of the present invention.

FIG. 1 is a vertical cross-sectional view showing schematically an overview of the inkjet recording apparatus 1 of the first embodiment of the present invention when viewed from a front side. FIG. 2 is a plan view of a periphery of a recording unit 20 in which wiper members 25K, 25C, 25M and 25Y are arranged corresponding to recording heads 22K, 22C, 22M and 22Y, and a conveyance unit 30, in the inkjet recording apparatus 1 according to the first embodiment.

Figure 2:
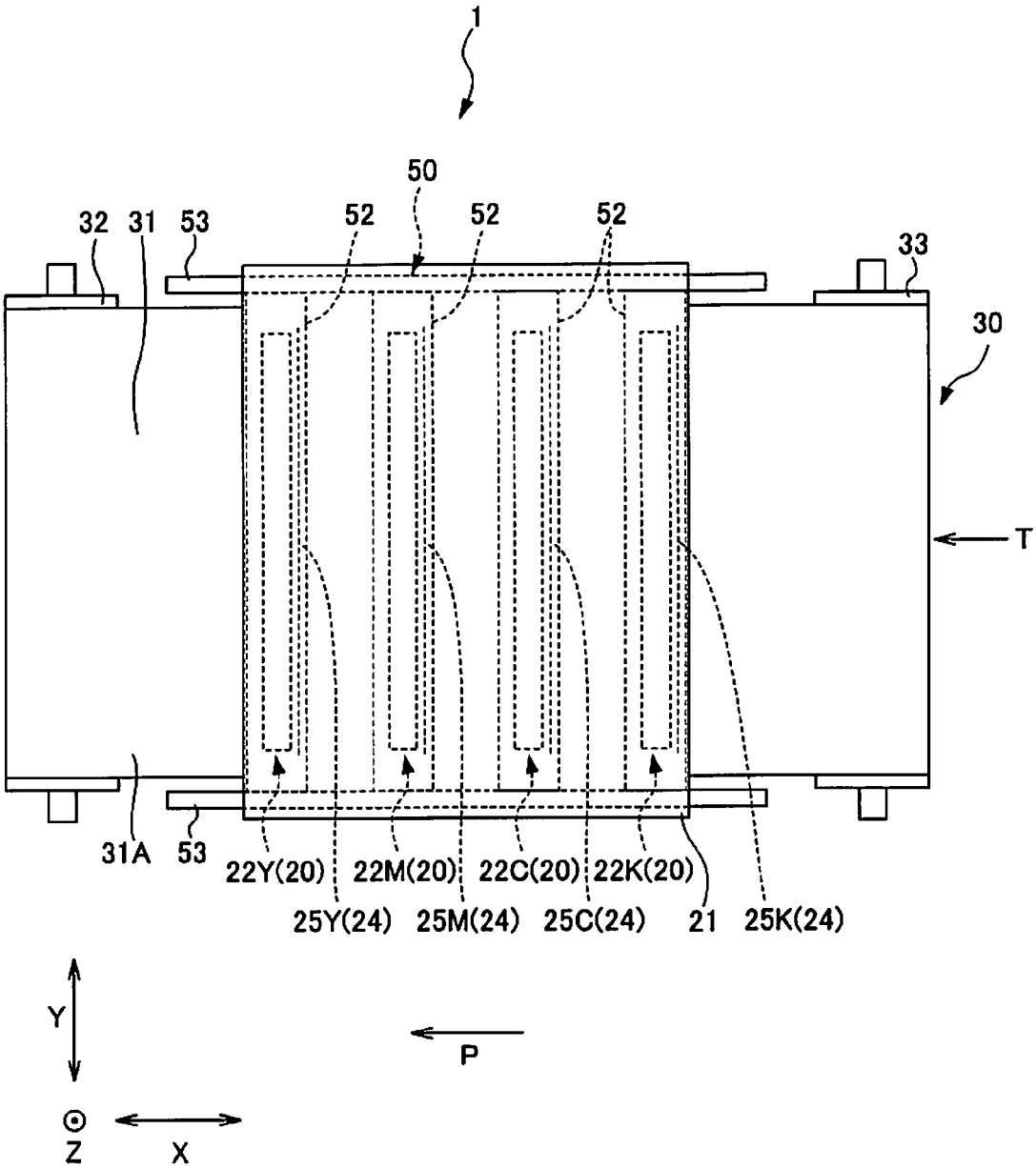
FIG. 2 is a plan view of a periphery of a recording unit 20 in which wiper members 25K, 25C, 25M and 25Y are arranged corresponding to recording heads 22K, 22C, 22M and 22Y, and a conveyance unit 30, in the inkjet recording apparatus 1 according to the first embodiment.

As shown in FIG. 1 and FIG. 2, the inkjet recording apparatus 1 according to the first embodiment includes, in a main body 2, a recording unit 20, a cleaning unit 24, a conveyance unit 30, a vertical movement device 40 which raises and lowers the conveyance unit 30, a cap unit 50, a first horizontal movement mechanism (not illustrated) which moves the cap unit 50 horizontally, and a second horizontal movement mechanism (not illustrated) which moves the cleaning unit 24 horizontally.

The inkjet recording apparatus 1 according to the first embodiment further includes a paper supply cassette 3, a paper feeding roller 4, a paper conveying path 5, a pair of resist rollers 6, a drying unit 7, a pair of paper discharging rollers 8, a paper discharging opening 9, and a paper discharging tray 10.

As shown in FIG. 1 and FIG. 2, the conveying unit 30 has a drive roller 32, a driven roller 33, a tension roller 34, a conveyor belt 31 that is wound about the drive roller 32, the driven roller 33 and the tension roller 34, and an air suction unit (not shown) which is provided on a lower side of a conveyance face of the conveyor belt 31 (opposite to the recording unit 20). The tension roller 34 adjusts the tension of the conveyor belt 31. A large number of through holes for suctioning (not shown) are provided on the conveyor belt 31 and an upper face of the air suction unit. A conveyance face 31A is formed on an upper surface of the conveyor belt 31.

When the drive roller 32 and the driven roller 33 rotate counter-clockwise viewed from the front, the conveyance face 31A horizontally moves in a paper conveying direction P on a horizontal plane (X-Y plane). In other words, on the conveyance face 31A of the conveyor belt 31, the paper conveying direction P coincides substantially with a horizontal direction X. The air suction unit is arranged on the lower side of the conveyance face 31A of the conveyor belt 31 (opposite to the recording unit 20), and applies a suction force which attracts a sheet of paper T as a recording medium onto the conveyance face 31A of the conveyor belt 31.

For the conveyor belt 31, it is possible to use an endless belt, both ends of which are mutually overlapped and bonded together, or a belt without a joint (seamless), or the like.

As shown in FIG. 2, when performing predetermined recording, the sheet of paper T as a recording medium is introduced to the conveyance face 31A of the conveyor belt 31 from one side of the paper conveying direction P. A suction force for suctioning the paper to the conveyance face 31A generated by the air suction unit is applied to the conveyance face 31A via the through holes for suction (not shown). The sheet of paper T introduced to the conveyance face 31A of the conveyor belt 31 is conveyed toward another side of the paper conveying direction P, while being suctioned to the conveyance face 31A by the suction force. Ink is ejected from the recording heads 22 of the recording unit 20 (described later) toward the sheet of paper T, which is conveyed while being suctioned to the conveyance face 31A by the suction force. In this manner, an image and the like are recorded (printed) on the sheet of paper T.

As shown in FIG. 1, the paper feeding cassette 3 accommodates sheets of paper T in a stacked state. The paper feeding cassette 3 is disposed in a lower part of the main body 2 and on an upstream side of the paper conveying direction P of the conveyance unit 30. The paper feeding roller 4 is disposed above the paper feeding cassette 3. The paper feeding roller 4 is disposed above the paper feeding cassette 3.

The paper conveying path 5, the pair of resist rollers 6, the recording unit 20 and the conveyance unit 30 are disposed downstream in the paper conveying direction P viewed from the paper feeding cassette 3. A sheet of paper T fed out from the paper feeding cassette 3 passes through the paper conveying path 5 and reaches the pair of resist rollers 6. The pair of resist rollers 6 temporarily stops the sheet of paper T for correcting its skew and then feeds again the sheet of paper T. A paper front end detection sensor (not shown) provided in the paper conveying path 5 between the recording unit 20 and the pair of resist rollers 6 detects a front end of a sheet of paper T. The recording unit 20 performs ink ejection (described later) based on timing of detection of the front end of the sheet of paper T.

As shown in FIG. 1, the drying device 7 is disposed in an upper part of the main body 2 and downstream in the paper conveying direction P when viewed from the conveyance unit 30. After recording with the ink ejected in the recording unit 20, the drying device 7 dries the ink on the sheet of paper T.

The pair of paper discharging rollers 8, the paper discharging opening 9 and the discharged paper tray 10 are arranged in this order downstream in the paper conveying direction P when viewed from the drying device 7. The sheet of paper T having completed drying of the ink is conveyed downstream in the paper conveying direction P by the pair of paper discharging rollers 8. The sheet of paper T is conveyed to the discharged paper tray 10 provided outside the main body 2 via the paper discharging opening 9 and discharged outside the main body 2.

As shown in FIGS. 1 and 2, the recording unit 20 is provided with recording heads 22K, 22C, 22M and 22Y corresponding to four colors. The recording heads 22K, 22C, 22M and 22Y are a recording head for black, a recording head for cyan, a recording head for magenta, and a recording head for yellow, respectively. The recording heads 22K, 22C, 22M and 22Y of the four colors extend in a paper width direction Y that is orthogonal to the paper conveying direction P (the horizontal direction X). The recording heads 22K, 22C, 22M and 22Y are disposed in this order along the paper conveying direction P of the conveyor belt 31, from upstream to downstream in the paper conveying direction P. In the first embodiment, one recording head is arranged for each of the recording heads 22K, 22C, 22M and 22Y of the four colors.

The recording heads 22K, 22C, 22M and 22Y of the four colors each have a nozzle face 221 (see FIG. 3) in which inkjet nozzles are formed. Nozzle faces 221 are respective lower surfaces of the recording heads of the four colors 22K, 22C, 22M and 22Y. The nozzle faces 221 of the recording heads 22K, 22C, 22M and 22Y are opposite to the conveyance face 31A of the conveyor belt 31. The recording heads 22K, 22C, 22M and 22Y of the four colors each record an image on a sheet of paper T by ink ejected from the inkjet nozzles formed in the nozzle faces 221.

As shown in FIG. 1, four ink tanks 23K, 23C, 23M and 23Y corresponding to the recording heads 22K, 22C, 22M and 22Y of the four colors are disposed below the conveyance unit 30. Inks of four colors are supplied from the four ink tanks 23K, 23C, 23M and 23Y to the recording heads 22K, 22C, 22M and 22Y via feeding tubes (not shown), respectively.

As shown in FIG. 2, the cleaning unit 24 has the plurality of wiper members 25K, 25C, 25M and 25Y arranged corresponding to the recording heads 22K, 22C, 22M and 22Y.

The wiper members 25K, 25C, 25M and 25Y are a wiper member 25K arranged corresponding to the recording head 22K, a wiper member 25C arranged corresponding to the recording head 22C, a wiper member 25M arranged corresponding to the recording head 22M, and a wiper member 25Y arranged corresponding to the recording head 22Y.

These wiper members 25K, 25C, 25M and 25Y are provided for the respective recording heads, respectively. More specifically, the wiper members 25K, 25C, 25M and 25Y are assigned to the corresponding recording heads 22K, 22C, 22M and 22Y on a one to one basis.

The wiper members 25K, 25C, 25M and 25Y move relative to the corresponding recording heads 22K, 22C, 22M and 22Y, thereby cleaning the nozzle faces 221 of the recording heads 22K, 22C, 22M and 22Y.

The wiper members 25K, 25C, 25M and 25Y of the cleaning unit 24 will be described in detail later.

It should be noted that, in the following description, reference symbols K, C, M and Y in the recording heads 22K, 22C, 22M and 22Y of the four colors, the four ink tanks 23K, 23C, 23M and 23Y, and the wiper members 25K, 25C, 25M and 25Y corresponding to the recording heads are omitted unless required for identification, and the recording heads, the ink tanks and the wiper members are simply referred to as "the recording heads 22," "ink tanks 23" and "the wiper members 25."

The recording heads 22 in the recording unit 20 respectively eject inks of four colors toward a sheet of paper T, which is conveyed with the conveyor belt 31 while being suctioned to the conveyance face 31A of the conveyor belt 31, according to the information related to image data (such as a character, a diagram and a pattern) received from an external computer (not shown). As shown in FIG. 2, each of the recording heads 22 is supported by a recording head supporting member 21 of a rectangular plate shape and fixed to the main body 2 along with the recording head supporting member 21. Along with the rotational movement of the conveyor belt 31, the inks of four colors are sequentially ejected from the recording heads 22 at predetermined timing after detection of a front end of the sheet of paper T by the paper front end detection sensor. As a result, the inks of black, cyan, magenta and yellow are overlapped on the sheet of paper T, thereby printing a color ink image on the sheet of paper T.

As an ink ejection method of the recording heads 22, various ejection methods such as a piezoelectric method and a thermal inkjet method may be adopted. The piezoelectric method employs a piezoelectric element (not shown) to apply pressure to ink and force out ink. The thermal inkjet method utilizes a heating element (not shown) to generate air bubbles so as to apply pressure and eject ink.

As shown in FIG. 1, the vertical movement device 40 of the conveyance unit 30 is disposed below the conveyance unit 30. The vertical movement device 40 lifts and lowers (moves) the conveyance unit 30 with respect to the recording heads 22 in a direction Z (hereinafter also referred to as "a vertical direction Z") that is vertical to the horizontal plane (X-Y plane). With the movement of the conveyance unit 30 performed by the vertical movement device 40 in the vertical direction Z, the conveyance face 31A of the conveyor belt 31 can relatively move close to and away from the nozzle faces 221 (see FIG. 3) of the recording heads 22.

As shown in FIG. 1, the vertical movement device 40 is provided with eccentric cams 41. The eccentric cams 41 are disposed below the conveyor belt 31, and upstream and downstream in the paper conveying direction P, respectively. Two eccentric cams 41 are disposed on each of the front and back sides of the conveyance unit 30: that is to say, four eccentric cams in total are disposed. An eccentric peripheral surface of each eccentric cam 41 contacts an outer bottom face of the conveyance unit 30 from a lower side thereof, via bearings 43 (described later). As shown in FIG. 1, each eccentric cam 41 includes an axis portion 42 that extends in the paper width direction Y and a cam having an eccentrically positioned rotational axis line. The eccentric cams 41 are rotated about axis portions 42 via a motor (not shown). Each eccentric cam 41 includes the bearings 43 in a peripheral portion thereof. A portion of a peripheral surface of each bearing 43 projects outward from a peripheral surface of each eccentric cam 41.

Each bearing 43 is supported rotatably about an axis line parallel to the rotational axis line of each eccentric cam 41. The bearings 43 are arranged sequentially from a front end to the rotational axis line of each eccentric cam 41. In a normal printing state, a bearing 43 that is the farthest from the axis portion 42 contacts the outer bottom face of the conveyance unit 30 from the lower side thereof, as shown in FIG. 1. Accordingly, the conveyance unit 30 is lifted to a highest position.

From this position, the vertical movement device 40 causes the eccentric cams 41 on the upstream side in the paper conveying direction P to rotate counterclockwise and the eccentric cams 41 on the downstream side in the paper conveying direction P to rotate clockwise, as viewed from front. In this manner, the bearings 43 sequentially contact the outer bottom face of the conveyance unit 30 in the order from a furthest bearing 43 to a closest bearing 43 with respect to the axis portion 42. Accordingly, the conveyance unit 30 can be lowered.

The bearings 43 are disposed at such intervals that there is a time period where two adjacent bearings 43 in a peripheral direction contact the outer bottom face of the conveyance unit 30 simultaneously while the eccentric cams 41 rotate.

When the conveyance unit 30 is lowered by rotation of the eccentric cams 41 of the vertical movement device 40, the conveyance face 31A of the conveyor belt 31 in the conveyance unit 30 is moved downward, away from the recording heads 22.

As shown in FIG. 1, the cap unit 50 is configured to be positionable below the recording unit 20 and above the conveyance unit 30 (between the recording unit 20 and the conveyance unit 30). As shown in FIG. 2, the cap unit 50 includes a plurality of cap cases 52 provided corresponding to the recording heads 22, and a cap base member 53 which supports and fixes the plurality of cap cases 52 in a prescribed positional relationship.

The cap unit 50 is configured to be movable vertically in conjunction with the lifting and lowering of the conveyance unit 30 by the vertical movement device 40, while the cap unit 50 is disposed between the recording unit 20 and the conveyance unit 30. When the conveyance unit 30 is lowered by rotation of the eccentric cams 41 of the vertical movement device 40, the cap unit 50 moves downward away from the recording heads 22, in conjunction with the conveyance face 31A of the conveyor belt 31.

Accordingly, the cap unit 50 is separated from the recording heads 22. It is possible to perform the ejection recovery processing (purge) for eliminating ink clogging while the cap unit 50 is separated from the recording heads 22. The recovery processing causes the ink which is high in viscosity as a result of remaining in the nozzles and the like to be ejected from the inkjet nozzles (not shown) in the nozzle face 221 of the recording head 22.

On the other hand, with lifting of the conveyance unit 30 by rotation of the eccentric cams 41 of the vertical movement device 40 in a direction opposite to the abovementioned direction, the conveyance unit 30 is restored to a normal recording position (printing position).

Figure 3:
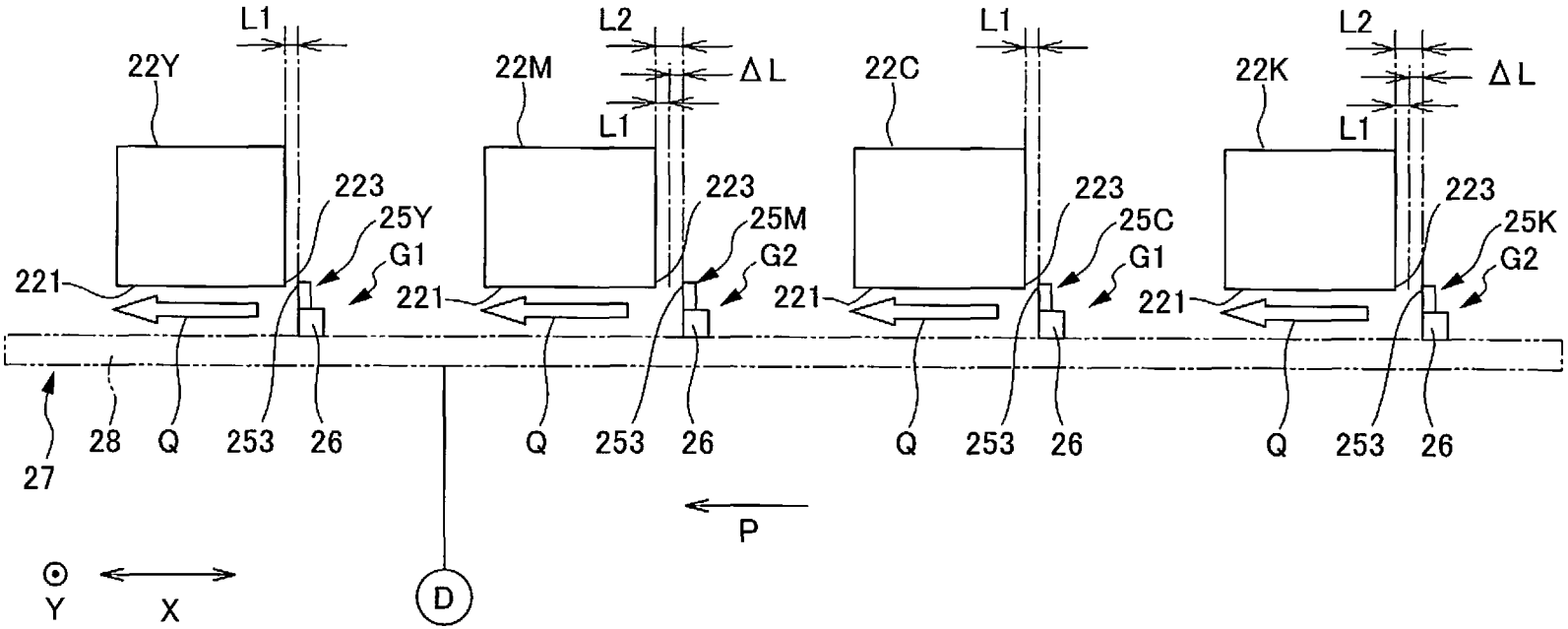
FIG. 3 is a front view showing an arrangement of the wiper members 25K, 25C, 25M and 25Y which are divided into two groups having different abutment distances with respect to the recording heads 22K, 22C, 22M and 22Y, in the inkjet recording apparatus 1 according to the first embodiment.

When the cap unit 50 is arranged between the recording unit 20 and the conveyance unit 30, it is possible to attach the cap unit 50 to the nozzle face 221 of the recording head 22 (see FIG. 3). In addition, when the cap unit 50 is not arranged between the recording unit 20 and the conveyance unit 30 by the first horizontal movement mechanism (not shown) as will be described later, the recording head 22 is able to eject ink toward a sheet of paper T which is placed on the conveyance face 31A of the conveyor belt 31.

The cap unit 50 is configured to be movable horizontally in the paper conveying direction P (see FIG. 1), following the horizontal movement of the cap base member 53 driven by the first horizontal movement mechanism (not shown).

The cap unit 50 is switched by the first horizontal movement mechanism between an attachment/detachment position and a standby position. The cap cases 52 can be attached and detached to and from the recording heads 22 at the attachment/detachment position. The cap cases 52 lie horizontally away from the attachment/detachment position at the standby position. The cap unit 50 is arranged at the standby position during a recording operation performed by the recording unit 20.

The cleaning unit 24 is configured to be positionable below the recording unit 20 and above the conveyance unit 30 (between the cap unit 50 and the conveyance unit 30). Similarly to the cap unit 50, the cleaning unit 24 is configured to be movable vertically in conjunction with the lifting and lowering of the conveyance unit 30 by the vertical movement device 40, while the cleaning unit 24 lies between the cap unit 50 and the conveyance unit 30.

Furthermore, the cleaning unit 24 is configured to be movable horizontally in the paper conveying direction P (see FIG. 1) by the second horizontal movement mechanism (not shown). The cleaning unit 24 is switched by the second horizontal movement mechanism between a wiping position and a standby position. The cleaning unit 24 is arranged below the recording heads 22 and able to clean the recording heads 22 at the wiping position. The cleaning unit 24 lies horizontally away from the wiping position at the standby position. The cleaning unit 24 is placed at the standby position, when a recording operation is performed by the recording unit 20 and the cap unit 50 is attached to the nozzle faces 221 of the recording heads 22 (see FIG. 3).

The wiper members 25 of the cleaning unit 24, which include technical features of the inkjet recording apparatus 1 according to the present embodiment, are described hereinafter with reference to FIG. 3 to FIG. 5D. In FIG. 5A to FIG. 5D, a wiper member 25 of a first group G1 is called a "the wiper member 25G1" and a wiper member 25 of a second group G2 is called a "the wiper member 25G2."

Figure 4:
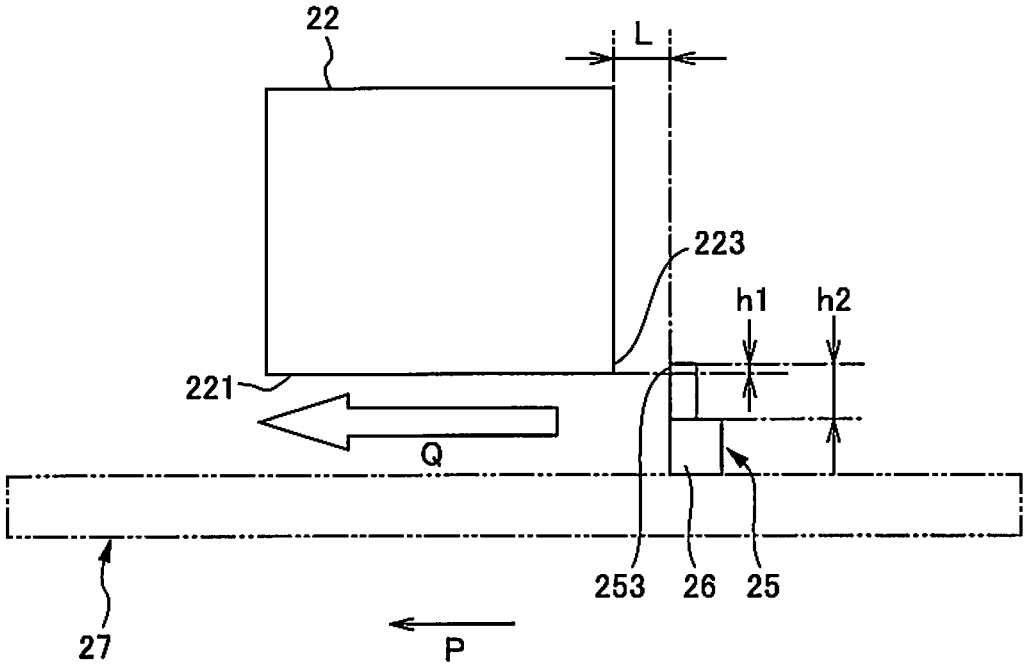
FIG. 4 is a front view showing a relationship between heights of recording heads 22 and wiper members 25 in a cleaning operation of the inkjet recording apparatus 1 according to the first embodiment.

FIG. 3 is a front view showing an arrangement of the wiper members 25K, 25C, 25M and 25Y which are divided into two groups having different abutment distances with respect to the recording heads 22K, 22C, 22M and 22Y, in the inkjet recording apparatus 1 according to the first embodiment. FIG. 4 is a front view showing a relationship between the height of recording heads 22 and wiper members 25 in a cleaning operation of the inkjet recording apparatus 1 according to the first embodiment.

Figure 5A:
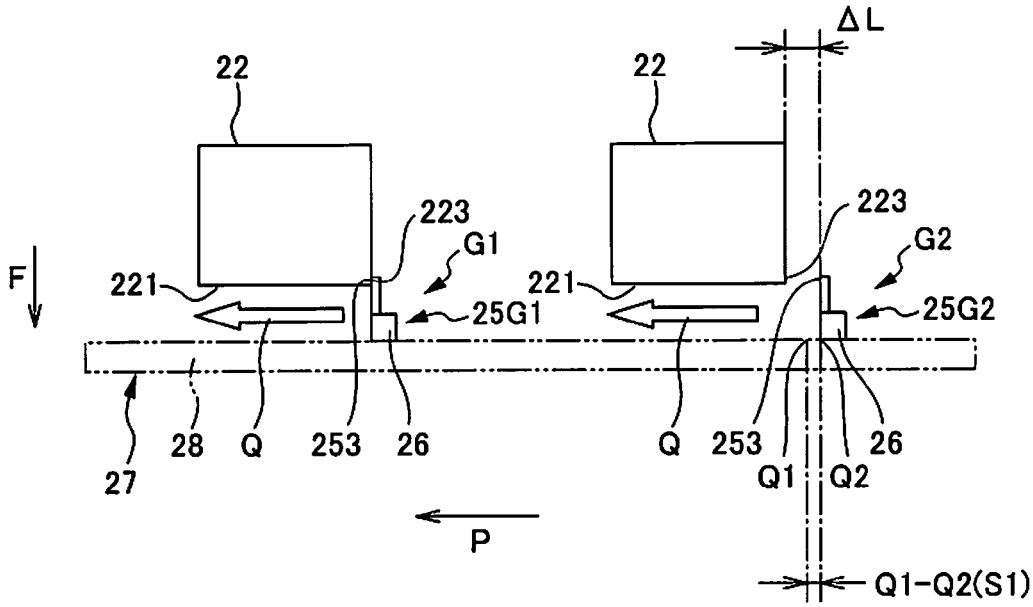
FIG. 5A illustrates a position of a wiper member 25G2 of a second group G2 at a time that a wiper abutment part 253 of a wiper member 25G1 of a first group G1 abuts against a recording head abutment part 223 of a corresponding recording head 22.
Figure 5B:
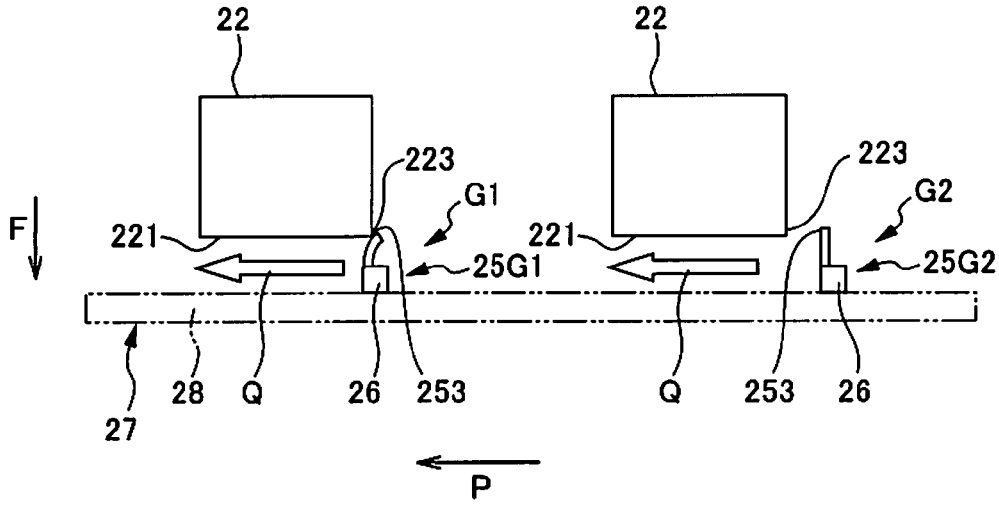
FIG. 5B illustrates a position of the wiper member 25G2 of the second group G2 at a time that the wiper member 25G1 of the first group G1 starts to bend.

FIG. 5A illustrates a position of a wiper member 25G2 of a second group G2 at the time that a wiper abutment part 253 of a wiper member 25G1 of a first group G1 abuts against a recording head abutment part 223 of a corresponding recording head 22. FIG. 5B illustrates a position of the wiper member 25G2 of the second group G2 at the time that the wiper member 25G1 of the first group G1 starts to bend.

Figure 5C:
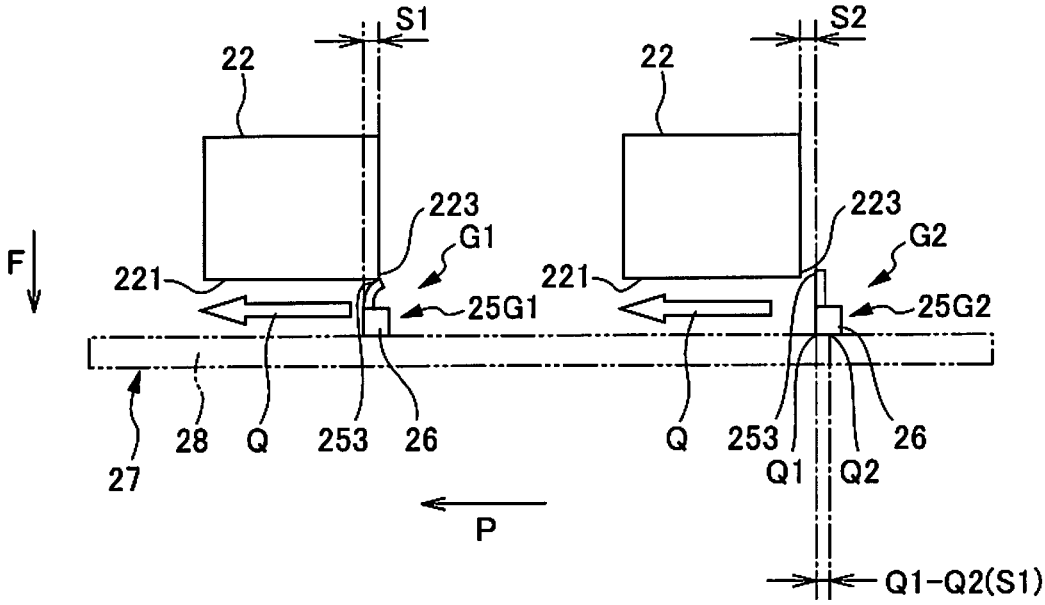
FIG. 5C illustrates a position of the wiper member 25G2 of the second group G2 at a time that the wiper member 25G1 of the first group G1 is arranged below a nozzle face 221 in an ink ejection direction F.
Figure 5D:
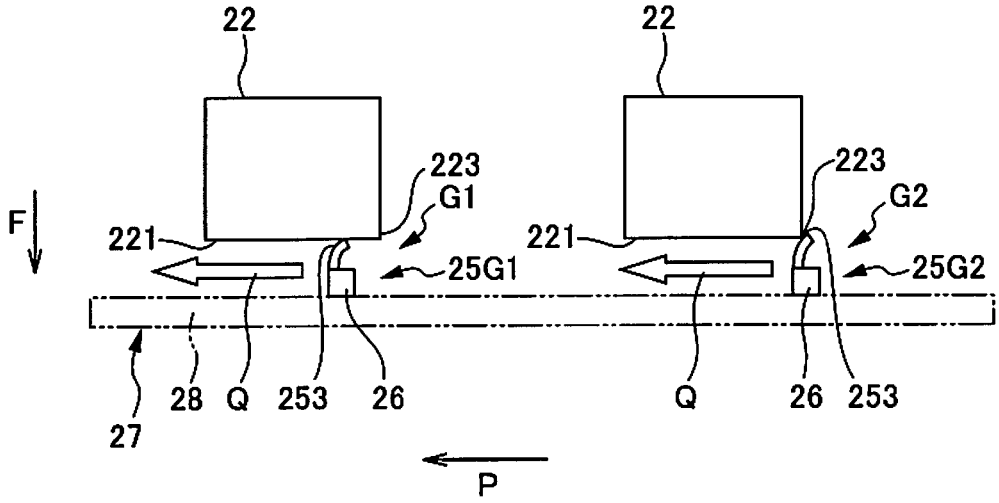
FIG. 5D is a diagram illustrating a state where the wiper member 25G2 of the second group G2 has started to bend, while the wiper member 25G1 of the first group G1 is moving in a steady bent state.

FIG. 5C illustrates a position of the wiper member 25G2 of the second group G2 at the time that the wiper member 25G1 of the first group G1 is arranged below a nozzle face 221 in an ink ejection direction F. FIG. 5D is a diagram illustrating a state where the wiper member 25G2 of the second group G2 has started to bend, while the wiper member 25G1 of the first group G1 is moving in a steady bent state.

As described above, the plurality of recording heads 22 in the recording unit 20 extend in the paper width direction Y perpendicular to the conveying direction P of the paper T, and are arranged sequentially in the paper conveying direction P.

As shown in FIG. 3, the plurality of wiper members 25 in the cleaning unit 24 are arranged upstream in the paper conveying direction P with respect to respective recording heads 22.

Each wiper member 25 is made of elastic material to shape like a plate. The wiper members 25 are erected (supported) substantially vertically (so as to extend in a vertical direction Z) on the wiper base 26, such that the wiper members 25 are perpendicular to the paper conveying direction P. With respect to the paper conveying direction Y, a length of each wiper member 25 is set to be greater than a length of each nozzle face 221 of each recording head 22 (see FIG. 2).

Each wiper member 25 moves relative to a corresponding recording head 22, in unison with the wiper base 26. Each wiper member 25 cleans a nozzle face 221 of the corresponding recording head 22 by wiping the nozzle face 221 with a front end (upper edge) of each wiper member 25.

More specifically, the wiper members 25 move in a wiping direction Q along the nozzle faces 221 after the front ends of the wiper members 25 abut against the recording heads 22, respectively. In this manner, the wiper members 25 perform cleaning of the nozzle faces 221.

In the present embodiment, the wiping direction Q coincides with the paper conveying direction P. Consequently, during a cleaning operation, the wiper members 25 move in the paper conveying direction P.

As shown in FIG. 3, the wiper members 25 are connected to a wiper movement unit 27. The wiper movement unit 27 causes the wiper members 25 to move in unison in the wiping direction Q.

The wiper movement unit 27 includes a single wiper supporting frame 28 and a drive mechanism (not shown). The wiper base 26 provided for the plurality of wiper members 25 is fixed to the single wiper supporting frame 28. The drive mechanism (not shown) causes the wiper supporting frame 28 to move back and forth in the wiping direction Q. The drive mechanism (not shown) includes a drive source (D) such as a motor. The drive source (D) is composed of a single component which drives the plurality of wiper members 25 simultaneously.

In the present embodiment, the wiper members 25 corresponding to the recording heads 22 are arranged in such a manner that timing at which at least one wiper member 25 of the wiper members 25 abuts against one recording head 22 differs from another timing at which another wiper member 25 that is different from the one wiper member 25 abuts against another recording head 22.

Here, as shown in FIG. 4, the recording heads 22 each have a recording head abutment part 223 against which the wiper member 25 first abuts when the wiper member 25 moves. Furthermore, the wiper members 25 each have a wiper abutment part 253 against which the recording head abutment part 223 abuts.

In the present embodiment, the recording head abutment part 223 is a side face of the recording head 22, the side face lying upstream in the paper conveying direction P. The wiper abutment part 253 is the front end of the wiper member 25. As shown in FIG. 4, a projecting height (projecting length) h2 of the wiper member 25 from the wiper base 26 is determined such that a predetermined height (overlap length) h1 is obtained to allow the wiper abutment part 253 to abut against the recording head abutment part 223, when the wiper member 25 moves in the wiping direction Q. The predetermined height (overlapping length) h1 which allows the wiper abutment part 253 to abut against the recording head abutment part 223 is the height of the wiper abutment part 253.

The wiper abutment part 253 abuts against the recording head abutment part 223 to produce bending of the wiper member 25. Due to the bending of the wiper member 25, the front end portion of the wiper member 25 contacts the nozzle face 221 while applying an elastic force of repulsion to the nozzle face 221.

Grouping of the plurality of wiper members 25 is now described.

As shown in FIG. 3, the plurality of wiper members 25 arranged on the wiper supporting frame 28 are divided into a plurality of groups having different abutment distances L, when the wiper members 25 do not move relative to the plurality of recording heads 22 (for example, a standby state before starting a cleaning operation). An abutment distance L indicates a distance between the recording head abutment part 223 and the wiper abutment part 253 corresponding to the recording head abutment part 223.

More specifically, in the present embodiment, as shown in FIG. 3, the wiper members 25 are divided into two groups: the first group G1 and the second group G2. The wiper members 25 belonging to the first group G1 are the wiper member 25Y corresponding to the recording head 22Y for yellow and the wiper member 25C corresponding to the recording head 22C for cyan. Similarly, the wiper members 25 belonging to the second group G2 are the wiper member 25M corresponding to the recording head 22M for magenta and the wiper member 25K corresponding to the recording head 22K for black.

More specifically, as shown in FIG. 4, the abutment distance L indicates a spaced distance between the recording head abutment part 223 and the wiper abutment part 253 in the standby state (a state before the start of a cleaning operation). The abutment distance L is specified respectively for each of the plurality of groups.

In the present embodiment, as shown in FIG. 3, the abutment distance of the wiper members 25 in the first group G1 is specified as abutment distance L1. The abutment distance of the wiper members 25 in the second group G2 is specified as abutment distance L2.

The abutment distance L2 of the wiper members 25 of the second group G2 is set to be greater than the abutment distance L1 of the wiper members 25 of the first group G1. By setting the abutment distances L1 and L2 in this way, the wiper members 25 of the second group G2 abut against the recording heads 22 when a prescribed time has elapsed after the wiper members 25 of the first group G1 have abutted against the recording heads 22.

As shown in FIG. 3, a difference ΔL in the abutment distances between the first group G1 and the second group G2, the wiper members of which abut against the recording head abutment parts 223 subsequent to the first group G1, is a difference between the abutment distance L2 (the abutment distance of the wiper members 25 in the second group G2) and the abutment distance L1 (the abutment distance of the wiper members 25 in the first group G1) (ΔL=L2-L1).

Consequently, at the moment that the wiper members 25 of the first group G1 abut against the recording head abutment parts 223 of the corresponding recording heads 22, the wiper members 25 of the second group G2, as shown in FIG. 5A, are positioned away from the recording head abutment parts 223 of the corresponding recording heads 22 by the difference ΔL of the abutment distances.

More specifically, as shown in FIG. 5A and FIG. 5C, the difference ΔL of the abutment distances is set to be greater than a difference between a first position Q1 (see FIG. 5C) and a second position Q2 (see FIG. 5A) (ΔL>Q1−Q2).

As shown in FIG. 5C, the first position Q1 is a position of the wiper abutment parts 253 of the second group G2 in the wiping direction Q, when the wiper members 25 of the first group G1 are arranged below the nozzle faces 221 (in other words, to the lower side of the nozzle faces 221) in the ink ejection direction F (the direction in which ink is ejected from the inkjet nozzles).

As shown in FIG. 5A, the second position Q2 is a position of the wiper abutment parts 253 of the second group G2 in the wiping direction Q, when the wiper abutment parts 253 of the first group G1 abut against the recording head abutment parts 223.

In other words, as shown in FIG. 5C, the difference ΔL of the abutment distances is set to be greater than a distance S1 (see FIG. 5C) at the time that the wiper members 25 of the first group G1 are arranged below the nozzle faces 221 in the ink ejection direction F. The distance S1 is a distance that the wiper base 26 of the wiper members 25 of the first group G1 advances in the wiping direction Q during a time period: from when the wiper abutment parts 253 abut against the recording head abutment parts 223 until the wiper members 25 are arranged below the nozzle faces 221. The distance S1 corresponds to a difference between the first position Q1 and the second position Q2 (S1=Q1−Q2).

Consequently, when the wiper members 25 of the first group G1 are arranged below the nozzle faces 221 in the ink ejection direction F, the wiper members 25 of the second group G2 have not reached the recording heads 22, as shown in FIG. 5C. At this time, there are gaps S2 between the wiper abutment parts 253 of the wiper members 25 of the second group G2 and the corresponding recording head abutment parts 223.

In the description given above, the time at which the wiper members 25 of the first group G1 are arranged below the nozzle faces 221 in the ink ejection direction F indicates a time at which the front end portions of the wiper members 25 have started to slide on the nozzle faces 221 in a stable bent state (a steady bent state) as shown in FIG. 5C. The sliding of the wiper members 25 occurs in the following manner: Due to the movement of the wiper members 25 in the wiping direction Q, the wiper abutment parts 253 first abut against the recording head abutment parts 223. Subsequently the engagement between the wiper abutment parts 253 and the recording head abutment parts 223 are released due to the bending of the wiper members 25 as a result of movement in the wiping direction Q.

The drive torque for driving the drive source, such as the motor, increases until the wiper members 25 reach the steady bent state, while the wiper abutment parts 253 engage with the recording head abutment parts 223. On the other hand, when the wiper members 25 which have reached the steady bent state are moved in the wiping direction Q, the load applied to the wiper members 25 is the frictional force between the wiper members 25 and the nozzle faces 221. Therefore, the drive torque for driving the motor when the wiper members 25 in the steady bent state is less than the drive torque required until the wiper members 25 reach the steady bent state (when the wiper abutment parts 253 engage with the recording head abutment parts 223).

Next, the operation of the wiper members 25 of the inkjet recording apparatus 1 according to the first embodiment will be described with reference to FIGS. 5A to 5D.

When a cleaning operation is performed, the plurality of wiper members 25 move from a standby position toward the recording heads 22 in unison with the wiper supporting frame 28, which is moved in the wiping direction Q by the wiper movement unit 27.

As shown in FIG. 5A, in this cleaning operation, the wiper abutment parts 253 of the wiper members 25G1 of the first group G1 first abut against the recording head abutment parts 223 of the corresponding recording heads 22. The wiper members 25G1 of the first group G1 have a smaller abutment distance than the wiper members 25G2 of the second group G2, of the wiper members 25 of the two groups. Under the circumstance described above, the wiper abutment parts 253 of the wiper members 25G2 of the second group G2 lie away from the recording head abutment parts 223 of the corresponding recording heads 22 by a distance ΔL (the difference of the abutment distances).

As shown in FIG. 5B, when the wiper supporting frame 28 moves in the wiping direction Q, the wiper members 25G1 of the first group G1 move in the wiping direction Q while the wiper abutment parts 253 engage with the recording head abutment parts 223. Accordingly, a front end portion of each wiper member 25G1 of the first group G1 starts to bend. The bending of the wiper members 25G1 of the first group G1 increases gradually. On the other hand, the wiper abutment parts 253 of the wiper members 25G2 of the second group G2 lie away from the recording head abutment parts 223 of the corresponding recording heads 22.

When the wiper supporting frame 28 moves in the wiping direction Q and the bending of the wiper members 25G1 of the first group G1 has reached a prescribed amount, the engagement between the wiper abutment parts 253 of the wiper members 25G1 and the recording head abutment parts 223 is released as shown in FIG. 5C. The wiper members 25G1 are arranged below the nozzle faces 221 in the ink ejection direction F. At this time, the front end portions of the wiper members 25G1 are in the stable bent state (the steady bent state). From this point, cleaning starts by the front end portion of each wiper member 25G1 wiping over the nozzle faces 221.

In this connection, the drive torque for driving the drive source, such as the motor, increases until the wiper members 25G1 of the first group G1 reach the steady bent state. On the other hand, when the wiper members 25G1 of the first group G1 in the steady bent state move in the wiping direction Q, the drive torque driving the drive source, such as the motor, is small.

More specifically, until the bending of the wiper members 25 reaches the steady bent state, the wiper members 25G1 of the first group G1 move in the wiping direction Q, while the wiper abutment parts 253 engage with the recording head abutment parts 223. In this manner, a reaction force acting in a direction opposite to the wiping direction Q is produced at the front ends of the wiper members 25G1 due to the bending of the wiper members 25. This reaction force caused by bending results in a force which opposes the movement of the wiper supporting frame 28 in the wiping direction Q. Accordingly, the drive torque for driving the drive source increases.

On the other hand, when the engagement between the wiper abutment parts 253 and the recording head abutment parts 223 is released, the load in the steady bent state is applied to the wiper members 25G1. In this manner, a frictional force between the wiper members 25G1 and the nozzle faces 221 acts as a resistance force to oppose the movement of the wiper supporting frame 28 in the wiping direction Q. Consequently, the drive torque for driving the drive source is reduced.

As shown in FIG. 5C, at the time that the engagement between the wiper abutment parts 253 and the recording head abutment parts 223 is released in the wiper members 25G1 of the first group G1, the wiper members 25G2 of the second group G2 have not yet abutted against the recording head abutment parts 223 of the corresponding recording heads 22.

While the wiper supporting frame 28 moves in the wiping direction Q, the wiper members 25G1 of the first group G1 advance a prescribed length on the nozzle faces 221 to clean the nozzle faces 221. As shown in FIG. 5D, the wiper abutment parts 253 of the wiper members 25G2 of the second group G2 abut against the recording head abutment parts 223 of the corresponding recording heads 22 and start to bend.

In terms of timing, the wiper members 25G2 of the second group G2 abut against the corresponding recording heads 22 after the bending of the wiper members 25G1 has reached the steady bent state subsequent to the abutment of the wiper members 25G1 of the first group G1 against the recording heads 22, and after the engagement between the wiper abutment parts 253 of the wiper members 25G1 and the recording head abutment parts 223 has been released.

In this manner, if the plurality of wiper members 25 is divided into two groups G1, G2, then the load applied to the drive source is distributed into: 1) a load applied to the drive source until the wiper members 25G1 of the first group G1 reach the steady bent state; and 2) a load applied to the drive source until the wiper members 25G2 of the second group G2 reach the steady bent state. Therefore, when the wiper members 25 are divided into groups, it is possible to reduce the load applied to the single drive source which simultaneously drives the plurality of wiper members 25, in comparison with a case where the wiper members 25 are not divided into groups.

Next, the wiper supporting frame 28 moves in the wiping direction Q, so that the wiper members 25G1 of the first group G1 move while in contact with the nozzle faces 221. During this time period, an amount of bending of the wiper members 25G2 of the second group G2 reaches the steady bent state. In this manner, the wiper members 25G2 of the second group G2, in which the engagement between the wiper abutment parts 253 and the recording head abutment parts 223 is released, start cleaning of the corresponding nozzle faces 221.

In the present embodiment, the wiper supporting frame 28 (wiper movement unit 27) returns to a standby state position once the wiper members 25G2 of the second group G2 have moved in the wiping direction Q until the wiper members 25G2 pass rear ends of the corresponding nozzle faces 221. In this manner, one time of cleaning process is completed.

According to the inkjet recording apparatus 1 of the present embodiment, the following advantages are obtained.

The inkjet recording apparatus 1 includes the plurality of recording heads 22 and the plurality of wiper members 25. The recording heads 22 each include a nozzle face 221 in which inkjet nozzles are formed, and record an image on a recording medium by ink ejected from the inkjet nozzles. The wiper members 25 are each arranged corresponding to each recording head 22 and perform cleaning of the nozzle face 221 of each recording head 22 by moving relative to each recording head 22. The wiper members 25 move in a wiping direction along nozzle faces 221 after respective front ends of the wiper members 25 abut against the recording heads 22. Timing at which at least one of the wiper members 25 abuts against one recording head 22 is different from another timing at which another wiper member 25 differing from the one wiper member 25 abutting against the one recording head 22 abuts against another recording head 22.

Therefore, the number of wiper members 25 which abut simultaneously against the recording heads is reduced compared with a case where all the wiper members 25 abut simultaneously against the recording heads. In this manner, it is possible to reduce the load applied to the drive source which drives the plurality of wiper members 25. Therefore, it is possible to prevent driving defects and the like in the drive source.

In addition, the inkjet recording apparatus 1 according to the present embodiment also includes a wiper movement unit 27 which moves the plurality of wiper members 25 in unison in the wiping direction Q.

Therefore, it is possible to move the plurality of wiper members 25 by a single drive source. In this manner, it is possible to simplify the configuration of a mechanism for moving the wiper members 25.

In the inkjet recording apparatus 1 according to the present embodiment, the recording heads 22 each have a recording head abutment part 223 against which a wiper member 25 abuts first when the wiper member 25 moves. The wiper members 25 each have a wiper abutment part 253 against which a recording head abutment part 223 abuts. The plurality of wiper members 25 are divided into the plurality of groups G1, G2 having different abutment distances. The abutment distance indicates the distance between the recording head abutment part 223 and the wiper abutment part 253 corresponding to the recording head abutment part 223, when the plurality of wiper members 25 do not move relative to the recording heads 22.

The abutment of the wiper members 25 against the recording heads 22 occurs at staggered timings in the respective groups G1 and G2. In this manner, the load on the drive source caused by the abutment of the recording heads 22 and the wiper members 25 is distributed. Consequently, it is possible to reduce the load applied to the drive source which drives the plurality of wiper members 25.

In the inkjet recording apparatus 1 according to the present embodiment, the abutment distance is specified for each of the groups G1 and G2. In addition, the difference ΔL between one abutment distance L1 of the first group G1 of the plurality of groups and the other abutment distance L2 of the second group G2 that abuts against the recording head abutment part 223 subsequently to the first group G1 is greater than the difference between the first position and the second position. The first position indicates where the wiper abutment part 253 of the second group G2 is located with respect to the wiping direction Q when the wiper member 25 of the first group G1 is arranged below the nozzle face 221 in the direction in which ink is ejected from the inkjet nozzles. The second position indicates where the wiper abutment part 253 of the second group G2 is located with respect to the wiping direction Q when the wiper abutment part 253 of the first group G1 abuts against the recording head abutment part 223.

In this manner, the wiper members 25 of the second group G2 abut against the recording heads 22 after the wiper members 25 of the first group G1 abut against the recording heads 22 and the drive torque for driving the drive source has been reduced. Consequently, it is possible to reduce the change in the load applied to the drive source until the completion of the abutment of the wiper members 25 against the recording heads 22. Therefore, it is possible to further reduce the load applied to the drive source which drives the wiper members 25.

In the inkjet recording apparatus 1 according to the present embodiment, the plurality of recording heads 22 are formed to extend in the paper width direction Y perpendicular to the paper conveying direction P, and are arranged sequentially in the paper conveying direction P. The wiper members 25 are moved in the paper conveying direction P.

In this manner, the wiping direction Q, which is the direction of movement of the wiper members 25, is along short edges of the recording heads 22, and an amount of movement of the wiper members 25 during a cleaning operation is reduced. Accordingly, it is possible to make the wiper movement unit 27 compact in size and shorten the time required for the cleaning process.

Second Embodiment

Figure 6:
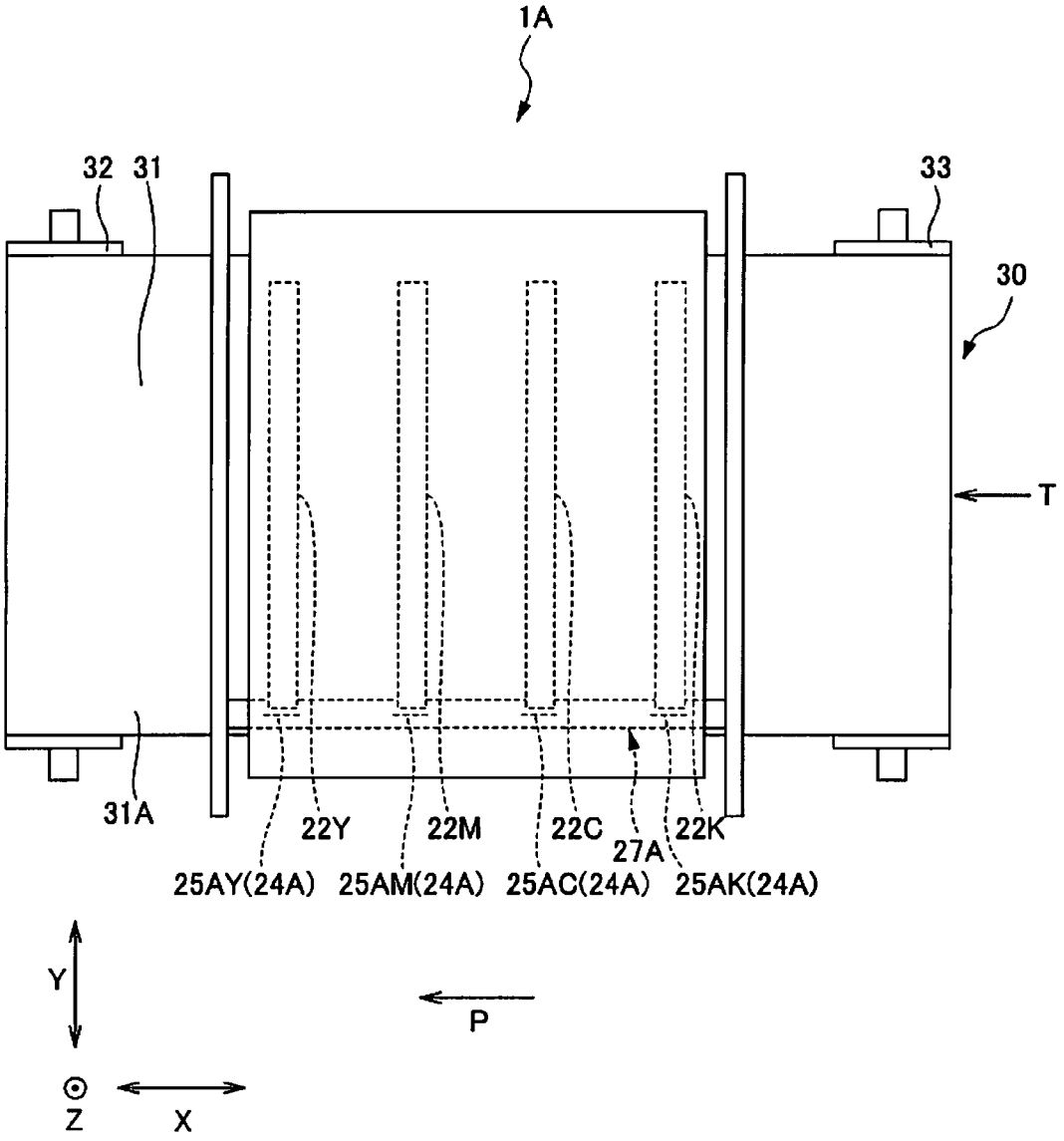
FIG. 6 is a plan view of a periphery of a recording unit 20A in which wiper members 25AK, 25AC, 25AM and 25AY are arranged corresponding to recording heads 22K, 22C, 22M and 22Y, and a conveyance unit 30, in an inkjet recording apparatus 1A according to a second embodiment of the present invention.
Figure 7A:
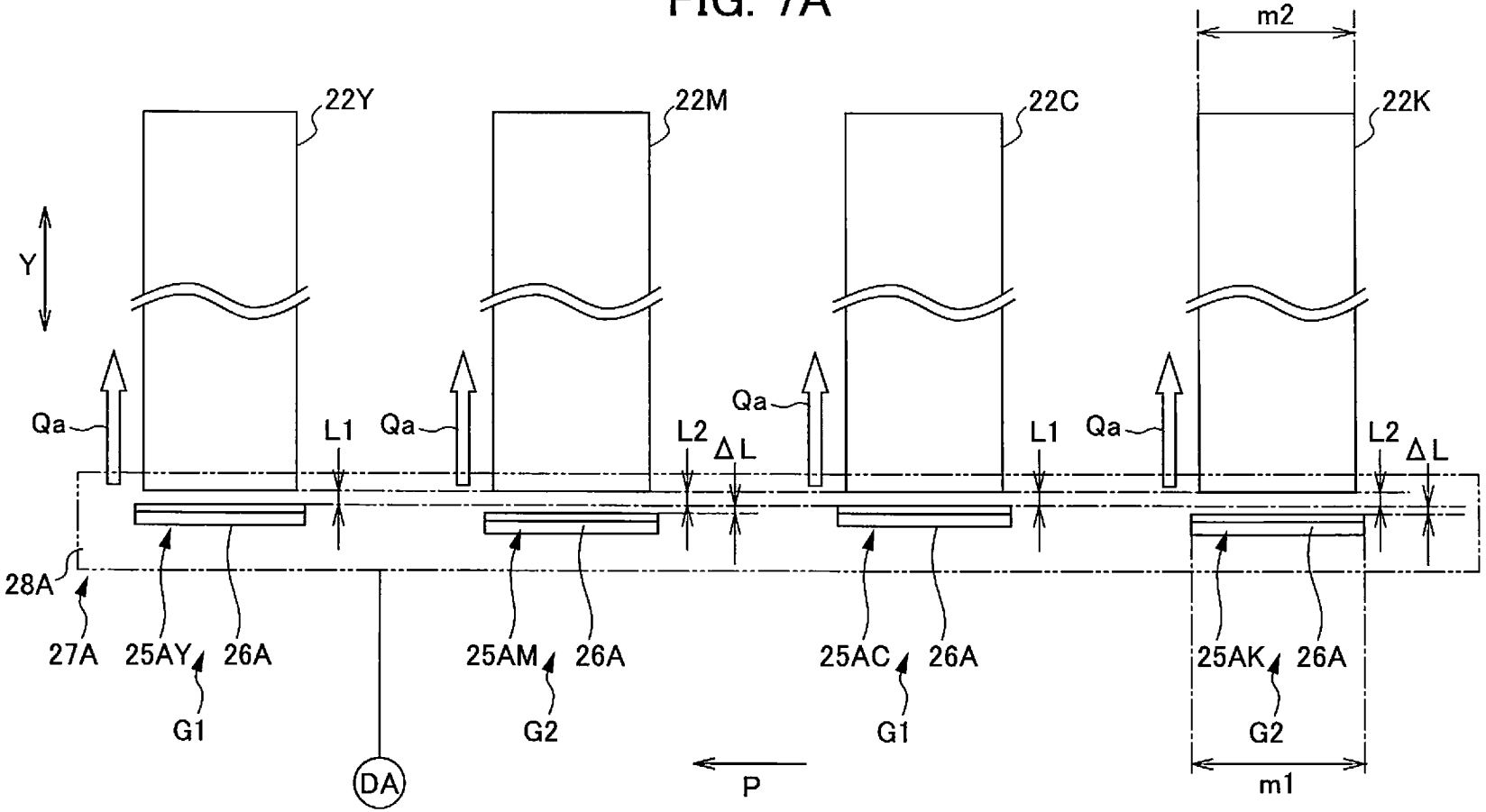
FIG. 7A is a plan view showing an arrangement of the wiper members 25AK, 25AC, 25AM and 25AY which are divided into two groups having different abutment distances with respect to the recording heads 22K, 22C, 22M and 22Y, in the inkjet recording apparatus 1A according to the second embodiment.
Figure 7B:
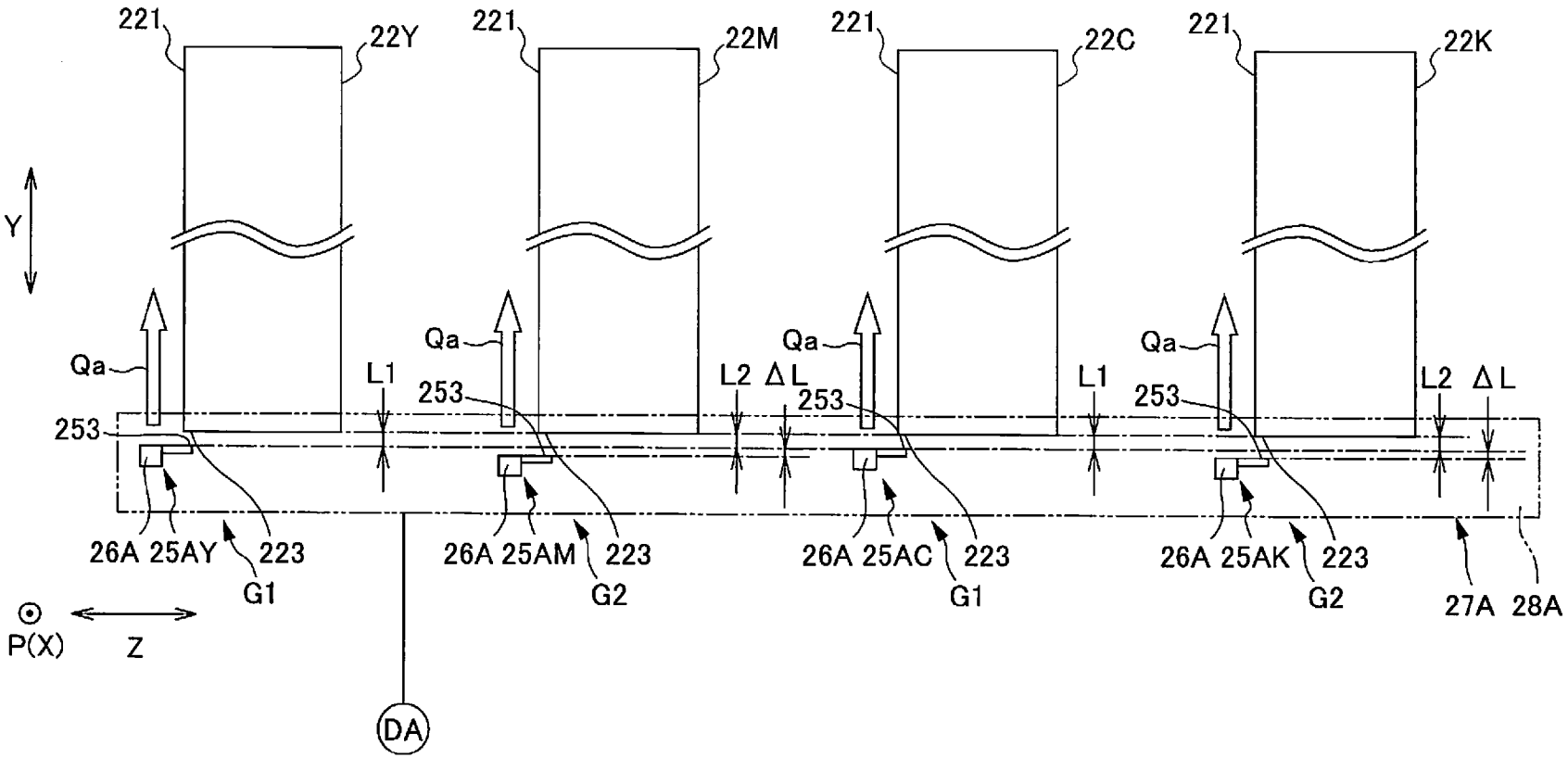
FIG. 7B is a schematic diagram viewed from a front side showing an arrangement of the wiper members 25AK, 25AC, 25AM and 25AY which are divided into two groups having different abutment distances in relation to the recording heads 22K, 22C, 22M and 22Y, in the inkjet recording apparatus 1A according to the second embodiment, in comparison with the recording heads 22K, 22C, 22M and 22Y for ejecting the respective colors of ink.

Next, a second embodiment is described with reference to FIG. 6 to FIG. 7B. FIG. 6 is a plan view showing a peripheral area of a recording unit in which wiper members 25AK, 25AC, 25AM and 25AY are arranged corresponding to respective recording heads 22K, 22C, 22M and 22Y, and a conveyance unit 30, in an inkjet recording apparatus 1A according to a second embodiment of the present invention. FIG. 7A is a plan view showing an arrangement of wiper members 25AK, 25AC, 25AM and 25AY which are divided into two groups having different abutment distances in relation to the recording heads 22K, 22C, 22M and 22Y, in the inkjet recording apparatus 1A according to the second embodiment. FIG. 7B is a schematic diagram showing an arrangement, viewed from a front side, of the wiper members 25AK, 25AC, 25AM and 25AY which are divided into two groups having different abutment distances in relation to the recording heads 22K, 22C, 22M and 22Y, in the inkjet recording apparatus 1A according to the second embodiment, in comparison with the recording heads 22K, 22C, 22M and 22Y of respective colors.

The inkjet recording apparatus 1A according to the second embodiment differs from the first embodiment in that the plurality of wiper members 25A of the cleaning unit 24A are configured to move in a paper width direction Y. With regard to the second embodiment, differences from the first embodiment are mainly described and components similar to the first embodiment are referred to by the same symbols, so that detail descriptions thereof will not be repeated. The descriptions given of the first embodiment are applicable or adaptable to the components that are not explained in the second embodiment.

As shown in FIG. 6, the cleaning unit 24A in the inkjet recording apparatus 1A according to the second embodiment includes a plurality of wiper members 25A which are arranged corresponding to the respective recording heads 22.

The plurality of recording heads 22K, 22C, 22M and 22Y corresponding to the four colors have the same configuration as the first embodiment. In other words, the recording heads 22K, 22C, 22M and 22Y corresponding to four colors are the recording head 22K for black, the recording head 22C for cyan, the recording head 22M for magenta, and the recording head 22Y for yellow. The recording heads 22K, 22C, 22M and 22Y of the four colors extend in the paper width direction Y that is perpendicular to a paper conveying direction P (a horizontal direction X).

The recording heads 22K, 22C, 22M and 22Y are arranged in this order along the paper conveying direction P of a conveyor belt 31, from upstream to downstream in the paper conveying direction P. In addition, one recording head is arranged in each of the recording heads 22K, 22C, 22M and 22Y of the four colors.

As shown in FIG. 7B, the recording heads 22K, 22C, 22M and 22Y of the four colors each have the nozzle face 221 in which inkjet nozzles are formed. Nozzle faces 221 are lower surfaces of the recording heads of the four colors 22K, 22C, 22M and 22Y. The nozzle faces 221 are opposite to a conveyance face 31A of the conveyor belt 31. The recording heads of the four colors 22K, 22C, 22M and 22Y record an image on paper T by ink ejected from the inkjet nozzles of the nozzle faces 221.

As shown in FIG. 6, the cleaning unit 24A has a plurality of wiper members 25AK, 25AC, 25AM and 25AY arranged corresponding to the recording heads 22K, 22C, 22M and 22Y.

The plurality of wiper members 25AK, 25AC, 25AM and 25AY which are arranged corresponding to respective recording heads 22 are a wiper member 25AK corresponding to the recording head 22K, a wiper member 25AC corresponding to the recording head 22C, a wiper member 25AM corresponding to the recording head 22M, and a wiper member 25AY corresponding to the recording head 22Y.

It should be noted that, in the following description, reference symbols K, C, M and Y of the wiper members 25AK, 25AC, 25AM and 25AY are omitted unless required for identification, and the wiper members are simply referred to as "the wiper members 25A."

As shown in FIG. 6, in the cleaning unit 24A according to the second embodiment, one wiper member 25A is arranged adjacent to one end portion of the recording head 22 of the corresponding ink color in the paper width direction Y (below the recording head 22 in FIG. 6). The wiper members 25A are configured to be movable in unison in the paper width direction Y.

More specifically, as shown in FIG. 7A and FIG. 7B, the wiper members 25A are each made of elastic material to shape like a plate. The wiper members 25A are erected substantially vertically (so as to extend in a vertical direction Z) on the wiper base 26 and perpendicular to the paper width direction Y. As shown in FIG. 7A, with respect to the paper conveying direction P, a length m1 of each member 25A is set to be greater than a length m2 (a short edge length) of each nozzle face 221 of the recording heads 22 (see FIG. 7B).

The wiper members 25A move relative to the corresponding recording heads 22 in unison with a wiper base 26A. The wiper members 25A clean the nozzle faces 221 of the recording heads 22 by wiping the nozzle faces 221 with front ends (upper edges) of the wiper members 25A.

More specifically, after the front ends of the wiper members 25A abut respectively against the recording heads 22, the wiper members 25A move in a wiping direction Qa along the nozzle faces 221 to perform cleaning of the nozzle faces 221.

In the present embodiment, the wiping direction Qa coincides with the paper width direction Y. Consequently, during a cleaning operation, the wiper members 25A move in the paper width direction Y.

The wiper members 25A are coupled to a wiper movement unit 27A. The wiper movement unit 27A causes the plurality of wiper members 25 to move in unison in the wiping direction Qa.

The wiper movement unit 27A includes a single wiper supporting frame 28A and a drive mechanism (not shown). The wiper base 26A provided for the plurality of wiper members 25A is fixed to the single wiper supporting frame 28A. The drive mechanism (not shown) causes the wiper supporting frame 28A to move back and forth in the wiping direction Qa. The drive mechanism (not shown) is driven by a drive source (DA) such as a motor. The drive source (DA) is composed of a single component which drives the plurality of wiper members 25 simultaneously.

In the second embodiment, the relationship of the arrangement in the height direction between the wiper members 25A and the nozzle faces 221 of the corresponding recording heads 22 is similar to that of the first embodiment (see FIG. 4).

In addition, in the second embodiment, similarly to the first embodiment, the wiper members 25A corresponding to the recording heads 22 of the respective colors are divided into two groups, the first group G1 and the second group G2. These two groups G1 and G2 each have different timing of abutment against the recording heads 22 during a cleaning operation.

As shown in FIG. 7A and FIG. 7B, the wiper members 25A of the first group G1 are the wiper member 25AY corresponding to the recording head 22Y for yellow and the wiper member 25AC corresponding to the recording head 22C for cyan. Similarly, the wiper members 25A of the second group G2 are the wiper member 25AM corresponding to the recording head 22M for magenta and the wiper member 25AK corresponding to the recording head 22K for black.

The abutment distance of each wiper member 25A of the first group G1 is set to an abutment distance L1, similarly to the first embodiment. The abutment distance of each wiper member 25A of the second group G2 is set to an abutment distance L2, similarly to the first embodiment.

During a cleaning operation, the wiper members 25A of the first group G1 abut earlier against the recording head abutment parts 223 of the corresponding recording heads 22 than the wiper members 25A of the second group G2. Similarly to the first embodiment, during a cleaning operation, the wiper members 25A of the second group G2 abut against the recording head abutment parts 223 of the corresponding recording heads 22 when the wiper members 25A of the first group G1 have reached a steady bent state after abutting against the recording head abutment parts 223.

Next, the operation of the wiper members 25A of the inkjet recording apparatus 1A according to the second embodiment will be described with reference to FIGS. 7A and 7B.

During a cleaning operation of the inkjet recording apparatus 1A according to the second embodiment, the wiper members 25A move in the wiping direction Qa in unison with the wiper supporting frame 28, that moves in the wiping direction Qa, similarly to the first embodiment. Due to a difference ΔL in abutment distances of the first group G1 and the second group G2, timing at which the wiper members 25A of the first group G1 abut against the corresponding recording head abutment parts 223 is different from timing at which the wiper members 25A of the second group G2 abut against the corresponding recording head abutment parts 223.

The wiper members 25A of the first group G1 first abut against the recording head abutment parts 223. When the wiper members 25A of the first group G1 have abutted against the recording head abutment parts 223 and reached the bending of the steady bent state, the wiper members 25A disengage from the recording head abutment parts 223 to start wiping (cleaning) the nozzle faces 221 in the steady bent state.

Next, the wiper members 25A of the second group G2 abut against the recording head abutment parts 223 after the wiper members 25A of the first group G1 have reached the steady bent state. When the wiper members 25A of the second group G2 have abutted against the recording head abutment parts 223 and reached the bending of the steady bent state, the wiper members 25A disengage from the recording head abutment parts 223 to start wiping (cleaning) the nozzle faces 221 in the steady bent state.

In this manner, the ink jet recording apparatus 1A according to the second embodiment has advantages similar to the first embodiment. If the plurality of wiper members 25 is divided into two groups G1, G2, then the load applied to the drive source is distributed into: 1) a load applied to the drive source until the wiper members 25A of the first group G1 reach the steady bent state; and 2) a load applied to the drive source until the wiper members 25A of the second group G2 reach the steady bent state. Therefore, when the wiper members 25A are divided into groups, it is possible to reduce the load applied to the single drive source which simultaneously drives the plurality of wiper members 25A, in comparison with a case where the wiper members 25A are not divided into groups.

In the second embodiment, the wiping direction Qa of the wiper members 25A coincides with the paper width direction Y. Therefore, the wiper members 25A perform cleaning of the recording heads 22 which are formed to extend in the paper width direction Y.

According to the inkjet recording apparatus 1A according to the second embodiment, the following advantages are obtained in addition to the advantages stated in the first embodiment.

In the inkjet recording apparatus 1A according to the second embodiment, the plurality of recording heads 22 are formed to extend in the paper width direction Y, which is perpendicular to the paper conveying direction P. In addition, the recording heads 22 are arranged sequentially in the paper conveying direction P. The wiper members 25A move in the paper width direction Y.

Accordingly, each wiper member 25A abuts against a side face along a shorter side of a recording head 22 and moves along a longer side of the recording heads 22. Consequently, it is possible to cause a length of each wiper member 25A in the paper conveying direction P (the direction perpendicular to the wiping direction Qa) to be shorter than a length of each wiper member 25 of the first embodiment, which moves in the paper conveying direction P.

Accordingly, it is possible to reduce the length of each wiper member 25A (the length in the direction perpendicular to the wiping direction Qa), which abuts against the recording head 22 and bends. Consequently, it is possible to reduce the load that occurs when the wiper members 25A abut against the recording heads 22 and bend, compared to the first embodiment. Therefore, it is possible to further reduce the load applied to the drive source which drives the plurality of wiper members 25A, compared to the first embodiment.

Preferred embodiments of the present invention have been described above; however, the present invention is not limited thereto and can be carried out in various modes.

For example, in the embodiments described above, the plurality of wiper members 25 and the plurality of wiper members 25A are each arranged to be divided into two groups, but the present invention is not limited thereto. Alternatively, the wiper members 25 and the wiper members 25A may be divided into three or more groups, which have mutually different timing to abut against the recording heads 22.

Although in the embodiments described above one of the two groups is composed of two wiper members 25, 25, the present invention is not limited thereto. One group may alternatively be composed of one wiper member 25.

Although in the second embodiment described above one recording head is assigned to each of the recording heads 22K, 22C, 22M and 22Y of the four colors, the present invention is not limited thereto. Alternatively, three recording heads may be arranged in series in the paper width direction Y for each of the recording heads 22K, 22C, 22M and 22Y, for example.

In this case, three wiper members 25 may be arranged in the paper width direction Y corresponding to the three recording heads 22, respectively and each recording head 22 may be cleaned by each wiper member 25. Alternatively, it may be possible to adopt a configuration in which a plurality of recording heads 22 arranged in the paper width direction Y are cleaned by one wiper member 25. In this configuration, it is possible to reduce the number of wiper members 25. Accordingly, it is possible to reduce the cost of the component parts of the inkjet recording apparatus 1.

What is claimed is:

1. An inkjet recording apparatus, comprising:

a plurality of recording heads each including a nozzle face in which inkjet nozzles are formed and recording an image on a recording medium by ink ejected from the inkjet nozzles; and a plurality of wiper members, each arranged corresponding to each recording head, and performing cleaning of the nozzle face of each recording head by moving relative to each recording head, wherein the wiper members move in a wiping direction along nozzle faces after respective front ends of the wiper members abut against the recording heads, and timing at which at least one of the wiper members abuts against one recording head is different from another timing at which another wiper member differing from the one wiper member abutting against the one recording head abuts against another recording head, and wherein the plurality of recording heads are formed to extend in a width direction perpendicular to a conveying direction of the recording medium and are arranged sequentially in the conveying direction, and the plurality of wiper members move in the conveying direction.

2. The inkjet recording apparatus according to claim 1, further comprising a wiper movement unit that moves the wiper members in unison in the wiping direction.

3. The inkjet recording apparatus according to claim 2, wherein the recording heads each have a recording head abutment part against which a wiper member first abuts when the wiper member moves, the wiper members each have a wiper abutment part against which the recording head abutment part abuts, the wiper members are arranged to be divided into a plurality of groups for which abutment distances are respectively defined, each comprising a distance between the recording head abutment part and the wiper abutment part corresponding to the recording head abutment part, in a state where the wiper members do not move relative to the recording heads, and one abutment distance of a first group is different from another abutment distance of a second group of the plurality of groups that abuts against the recording head abutment part subsequent to the first group.

4. The inkjet recording apparatus according to claim 3, wherein a difference between the one abutment distance of the first group and the another abutment distance of the second group is greater than a difference between a first position and a second position, wherein the first position indicates where a wiper abutment part of the second group is located with respect to the wiping direction when a wiper member of the first group is arranged below the nozzle face in a direction in which ink is ejected from the inkjet nozzles, and wherein the second position indicates where a wiper abutment part of the second group is located with respect to the wiping direction when the wiper abutment part of the first group abuts against the recording head abutment part.

5. The inkjet recording apparatus according to claim 2, wherein the wiper movement unit includes a wiper supporting frame that directly or indirectly supports the plurality of wiper members and a drive mechanism that causes the wiper supporting frame to move.

6. The inkjet recording apparatus according to claim 2, wherein the wiper movement unit moves the wiper members until the wiper members have passed rear ends, in the wiping direction, of the nozzle faces of the recording heads corresponding to the respective wiper members, and terminates a cleaning process performed by the wiper members by returning the wiper members to a predetermined standby position.

7. The inkjet recording apparatus according to claim 1, further comprising:

a wiper base that supports the wiper members and causes the wiper members to move in unison.

8. The inkjet recording apparatus according to claim 1, wherein the wiper members comprise elastic bodies.

9. An inkjet recording apparatus, comprising:

a plurality of recording heads each including a nozzle face in which inkjet nozzles are formed and recording an image on a recording medium by ink ejected from the inkjet nozzles; and a plurality of wiper members, each arranged corresponding to each recording head, and performing cleaning of the nozzle face of each recording head by moving relative to each recording head, wherein the wiper members move in a wiping direction along nozzle faces after respective front ends of the wiper members abut against the recording heads, and timing at which at least one of the wiper members abuts against one recording head is different from another timing at which another wiper member differing from the one wiper member abutting against the one recording head abuts against another recording head, and wherein the plurality of recording heads are formed to extend in a width direction perpendicular to a conveying direction of the recording medium and are arranged sequentially in the conveying direction, and the plurality of wiper members move in the width direction.

10. An inkjet recording apparatus, comprising:

a plurality of recording heads each including a nozzle face in which inkjet nozzles are formed and recording an image on a recording medium by ink ejected from the inkjet nozzles;

a plurality of wiper members, each arranged corresponding to each recording head, and performing cleaning of the nozzle face of each recording head by moving relative to each recording head;

a wiper movement unit that moves the wiper members in unison in a wiping direction along nozzle surfaces; and a single drive source configured to drive the wiper movement unit, wherein the wiper members move in the wiping direction after respective front ends of the wiper members abut against the recording heads, and timing at which at least one of the wiper members abuts against one recording head is different from another timing at which another wiper member differing from the one wiper member abutting against the one recording head abuts against another recording head, and wherein the drive source drives the wiper movement unit to cause the plurality of wiper members to perform wiping of the plurality of the recording heads.

* * * * *